US012208484B2

(12) United States Patent
Luna

(10) Patent No.: US 12,208,484 B2
(45) Date of Patent: Jan. 28, 2025

(54) SUPPORT ASSEMBLY FOR SURFACE TREATMENT PAD

(71) Applicant: Kenneth Luna, Tustin, CA (US)

(72) Inventor: Kenneth Luna, Tustin, CA (US)

( * ) Notice: Subject to any disclaimer, the term of this patent is extended or adjusted under 35 U.S.C. 154(b) by 577 days.

(21) Appl. No.: 17/476,103

(22) Filed: Sep. 15, 2021

(65) Prior Publication Data

US 2023/0079249 A1 Mar. 16, 2023

(51) Int. Cl.
*B24D 13/14* (2006.01)
*B24B 41/00* (2006.01)
*B24D 9/08* (2006.01)

(52) U.S. Cl.
CPC ..... *B24B 41/002* (2013.01); *B24D 9/08* (2013.01); *B24D 13/147* (2013.01)

(58) Field of Classification Search
CPC ..... B24B 37/20; B24B 37/22; B24B 37/24; B24B 37/245; B24B 19/26; B24B 19/265; B24D 3/001; B24D 3/002; B24D 9/08; B24D 9/085; B24D 11/02; B24D 13/14; B24D 13/147; B24D 13/20; B24D 18/0045
USPC ..... 451/538, 539
See application file for complete search history.

(56) References Cited

U.S. PATENT DOCUMENTS 2,114,967 A * 4/1938 Myers ..... B24D 9/08 451/511
3,236,010 A * 2/1966 Evans ..... B24B 19/26 451/41
3,241,268 A * 3/1966 Olson ..... B24D 9/08 451/442
3,583,111 A * 6/1971 Volk ..... B24B 13/01 451/490
3,808,753 A * 5/1974 Maran ..... B24D 9/085 451/490
2005/0227599 A1* 10/2005 Fisher ..... B24D 9/085 451/526
2008/0171502 A1* 7/2008 Stephane ..... B24D 9/08 451/512
2016/0096253 A1* 4/2016 Givens ..... B24D 13/142 451/529

(Continued)

FOREIGN PATENT DOCUMENTS

EP 0112405 A1 * 7/1984

OTHER PUBLICATIONS

Fabritius, Hans J, EP 0112405 A1, Jul. 4, 1984; translation (Year: 1984).*

*Primary Examiner* — Brian D Keller
*Assistant Examiner* — Marcel T Dion
(74) *Attorney, Agent, or Firm* — Roland J. Tong

(57) ABSTRACT

A support assembly for supporting a surface treatment pad on a backing plate mounted on the spindle of a surface treatment tool includes a plurality of petal-shaped segments, each segment separated from an adjacent segment by a radially extending slit. The support assembly, which may be a unitary body printed from a single material using a 3-D printer may include three layers: a rear layer that rests against the backing plate, a front layer that rests against the surface treatment pad and includes the petal-shaped segments, and a compressible central layer interposed between the rear and front layers. The front layer may also include circumferentially extending grooves and ribs.

1 Claim, 3 Drawing Sheets

(56) References Cited

U.S. PATENT DOCUMENTS

| | | | | |
|---|---|---|---|---|
| 2019/0168361 | A1* | 6/2019 | Brandstetter | B24D 13/14 |
| 2020/0353588 | A1* | 11/2020 | Lefevre | B24B 37/24 |

* cited by examiner

SUPPORT ASSEMBLY FOR SURFACE TREATMENT PAD

BACKGROUND OF THE INVENTION

1. Field of the Invention

The present disclosure relates in general to surface treatment tools and more specifically to a support assembly for supporting a surface treatment pad on a backing plate mounted on a spindle of a surface treatment device.

2. Background Art

A typical automotive buffing or polishing machine comprises a backing plate mounted on a spindle driven by an electric motor. A buffing or polishing pad is detachably secured to the backing plate by hook and loop fasteners.

A good quality backing plate must be highly durable and capable of dampening vibrations from the electric motor. It should evenly distribute the weight and pressure of the machine across the buffing or polishing pad, and it needs to minimize heat transfer. In addition, the backing plate must be flexible enough to conform to the curves of the vehicle being polished. Although some types of backing plates are marketed as being flexible, very few if any are sufficiently flexible to allow 100% surface contact in hard-to-reach areas of heavily contoured vehicles.

These and other problems are addressed by this disclosure as summarized below.

SUMMARY OF THE INVENTION

The present disclosure relates to a support assembly to be interposed between a backing plate mounted on the spindle of a surface treatment tool and a surface treatment pad. The support assembly includes a plurality of petal-shaped segments, each segment separated from an adjacent segment by a radially extending slit. Each slit may have a widened mouth opening into the circumference.

In one aspect of the disclosure the support assembly includes a rear support layer, a front support layer, and a compressible center layer sandwiched between the front and rear support layers. The petal-shaped segments are formed in the front support layer.

In another aspect of the disclosure, the front layer may have at least one circumferentially extending groove that functions as a fold line along which a petal-shaped segment may bend in response to compressive forces. A plurality of circumferentially extending ribs may be located radially inwardly and outwardly of the groove or grooves.

In still another aspect of the disclosure, the rear, front, and center layers of the support assembly are formed as a unitary body printed from a 3D printer. The unitary body may be made from a single material, wherein each of the three layers has a different microstructure than the adjacent layers, giving each layer different mechanical properties. In a preferred embodiment, the rear layer is relatively rigid; the front layer is relatively flexible; and the central layer is relatively compressible.

In yet another aspect of the disclosure, the diameter of the front layer is greater than the diameter of the rear layer.

In yet another aspect of the disclosure, the support assembly is coupled to the backing plate and surface treatment pad by rear and front attachment layers. The rear attachment layer comprises a first part of a first two-part fastener configured to detachably secure a rear surface of the rear plate to a front surface of the backing plate. The front attachment layer comprises a first part of a second two-part fastener configured to detachably secure a front surface of the front layer to a rear surface of the surface treatment pad. The two-part fasteners may be hook and loop type fasteners.

DETAILED DESCRIPTION OF THE PREFERRED EMBODIMENTS

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
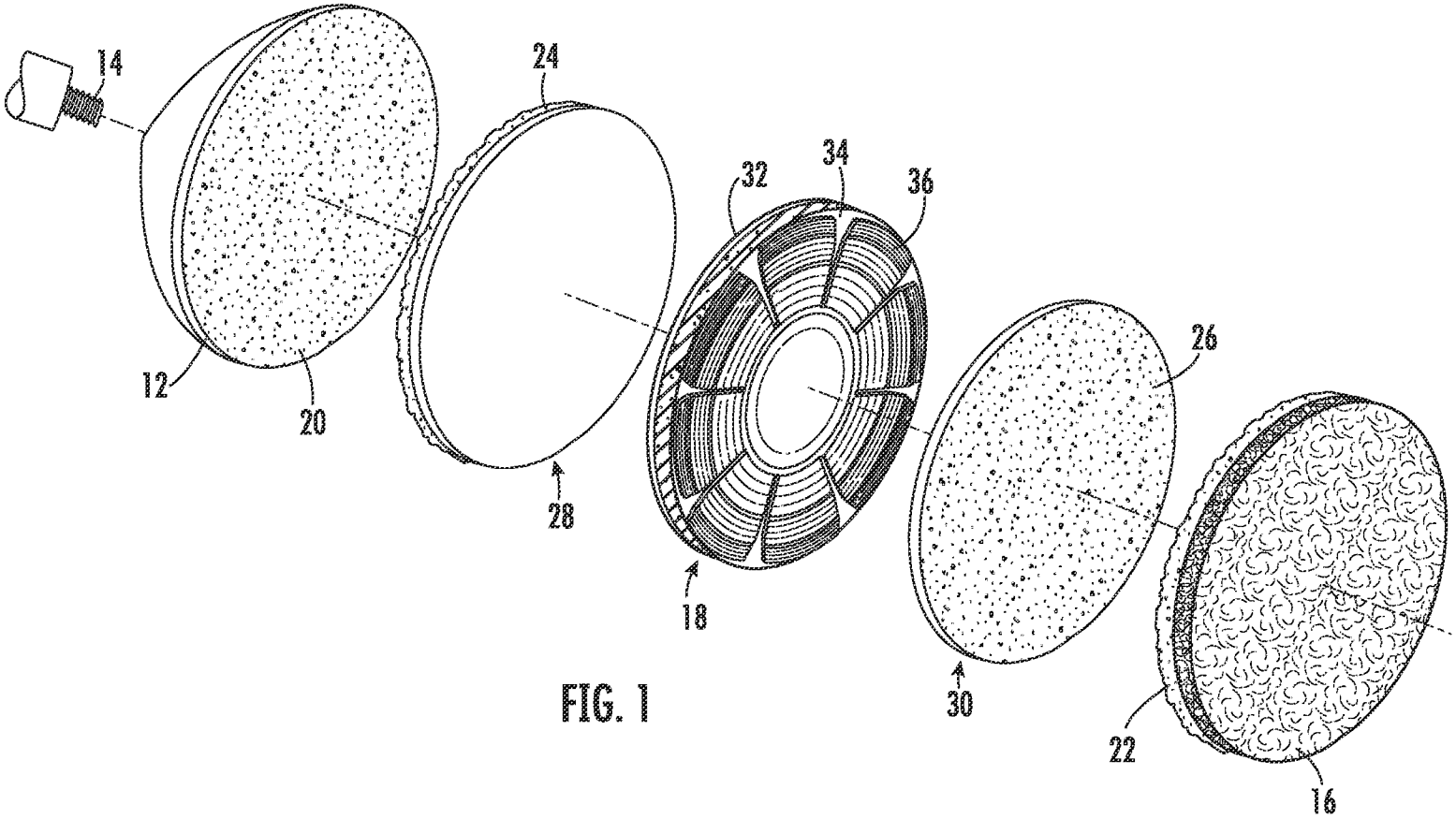
FIG. 1 is a perspective view showing a support assembly in exploded relationship to a backing plate and a surface treatment pad.

FIG. 1 shows a surface treatment assembly comprising a backing plate 12 mounted on a spindle 14 of a surface treatment tool, a surface treatment pad 16, and a support assembly 18 interposed between the backing plate 12 and the surface treatment pad 16. In a preferred example, the surface treatment tool is an automotive buffing or polishing tool, and the surface treatment pad 16 is a buffing or polishing pad. However, the support assembly 18 may be adapted for use with other types of surface treatment tools as well. For instance, it may be mounted between a sanding machine and a sanding pad or a scrubbing machine and a scrubbing pad.

In a conventional arrangement, the surface treatment pad 16 would be detachably secured directly to the backing plate 12 by means of a two-part fastening releasable fastener, such as a "Velcro"-type fastener consisting of a set of hooks 20 coupled to or embedded in the front surface of the backing plate 12 and a set of mating loops 22 coupled to the rear surface of the surface treatment pad 16. In the present invention, the support assembly 18 is mounted between the backing plate 12 and the surface treatment pad 16, using the same hooks and loops 20, 22, in combination with additional loops and hooks provided at the rear and front of the support assembly 18. More specifically, the hooks 20 on the front of the backing plate 12 mate with loops 24 on the rear surface of a fastening disk 28 which is glued or otherwise secured to the rear side of the support assembly 18, and the loops 22 on the rear of the surface treatment pad 16 mate with hooks 26 on the front surface of a fastening disc 30 which is glued or otherwise secured to the front side of the support assembly 18.

The support assembly 18 includes three layers: a thin, relatively rigid rear layer 32 for placement against the backing plate of the surface treatment tool, a thin, more flexible front layer 36 for placement against the surface treatment pad, and a compressible central layer 34 disposed between the rear and front layers 32, 36. In a preferred embodiment, both the rear layer 32 and the front layer 36 are 1/16" thick, and the central layer is ½" thick.

In some embodiments, the rear, front, and central layers may be made from different materials having different properties. However, in a preferred embodiment, all three layers are part of a unitary body that has been printed from a single material using a 3-D printer, wherein the microstructure of each layer has been varied to achieve the desired properties. Specifically, the body has been printed from urethane or a similar plastic, and the printer has been programmed such that the microstructure of the rear layer 32 results in a relatively high modulus of elasticity, while the microstructure of the front layer 34 results in a lower modulus of elasticity, and the microstructure of the central layer 34 results in a spongy, compressible texture.

Figure 2:
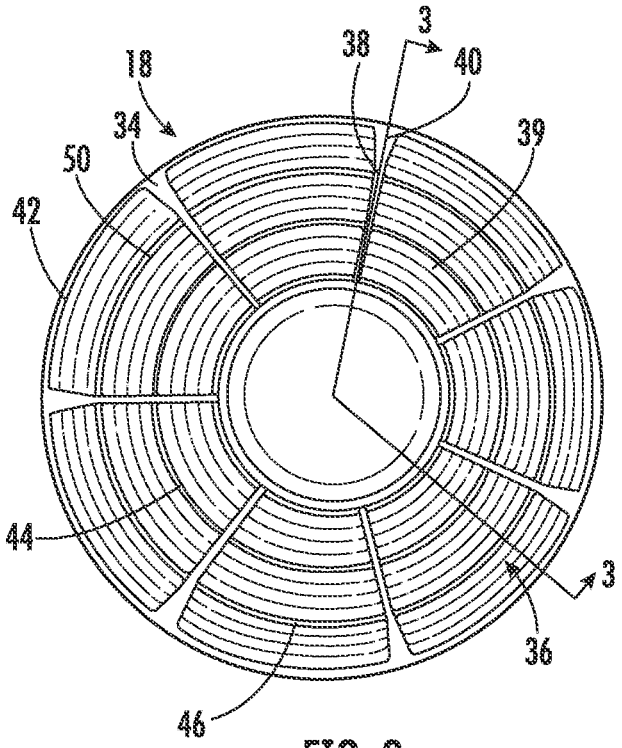
FIG. 2 is a front view of a support assembly.
Figure 3:
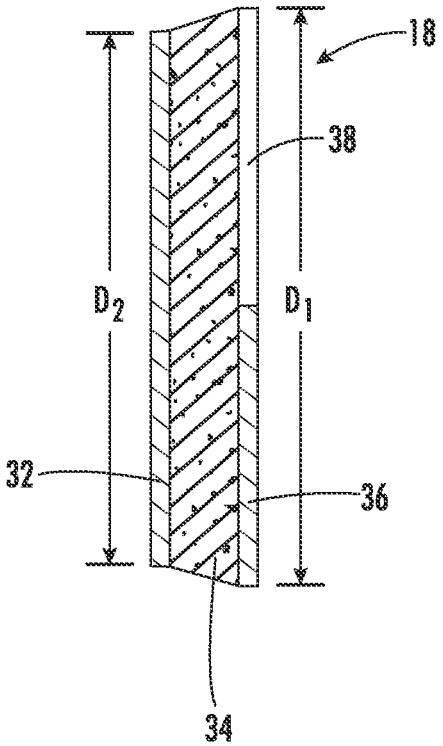
FIG. 3 is a sectional view taken through line 3-3 of FIG. 2.

With additional reference to FIGS. 2 and 3, the front layer 36 includes a number of radially extending slits 38 which separate the layer 36 into a number of petal-shaped segments 39 and reveal the underlying central layer 34. The sides of each slit 38 diverge to form a widened, V-shaped mouth 40 opening into the circumference 42 of the front layer 36. The slits 38 allow the petal-shaped segments 39 to flex independently of one another in response to uneven forces. In addition, a pair of radially spaced apart, circumferentially extending grooves 44, 46 allow inner, outer, and central portions of each segment 39 to flex independently of one another. For instance, a force exerted near the outer circumference 42 of the front layer 36 will cause the portion of a petal-shaped segment between the outermost groove 48 and the outer circumference to bend away from the force, while the remainder of the petal-shaped segment may remain straight. The front layer 36 may also include a number of circumferentially reinforcement ribs 50 located radially inwardly and outwardly of the grooves 44, 46.

The front layer 36 preferably has a diameter $D_1$ which is somewhat larger than the diameter $D_2$ of the rear layer 32. For instance, the diameter $D_1$ of the front layer 36 may be about 6.25" and the diameter $D_2$ of the rear layer 32 may be about 6." Among other things, this allows enough overhang to prevent the rear layer 32 from scratching the polished surface.

The slits 38, the grooves 44, 46, and the microstructure of the material combine with one another to enhance the flexibility of the front layer 36. This enhanced flexibility allows portions of the front layer 36 to be pressed rearwardly into the spongy center layer 34 in response to forces exerted on and by the surface treatment pad as it is maneuvered over a contoured surface. When the surface treatment pad moves over flatter surfaces, the spongy center layer 34 returns to its original form, pushing the portions of the front layer back outwardly. As a result, the surface treatment pad is able to "hug" the contours of a wide variety of surfaces, resulting in a smoother, more uniform finish than is possible with conventional surface treatment assemblies.

Figure 4:
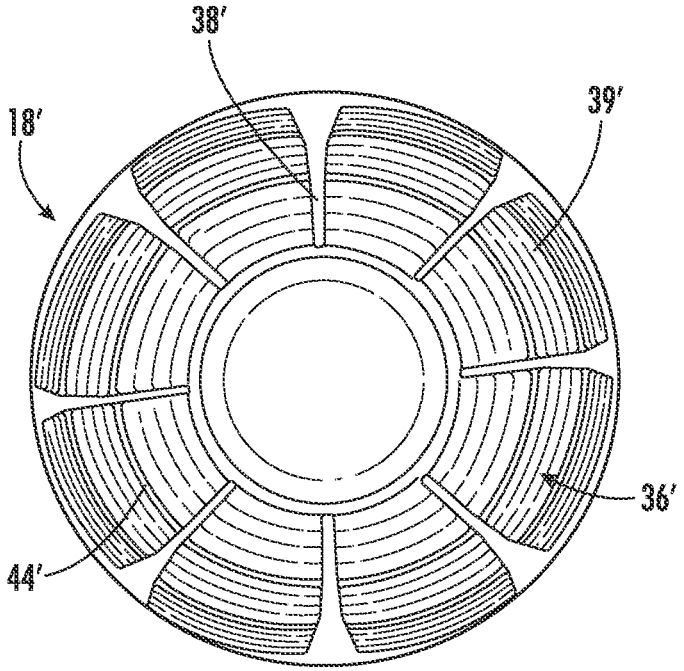
FIG. 4 is a front view showing a front view of an alternate embodiment of a support assembly.

FIG. 4 shows an alternate configuration for a support assembly 18', wherein the front layer 36' includes eight radially extending slits 38' and eight petal-shaped segments 39', in contrast to the seven slits and segments in the embodiment of FIG. 3. In addition, only one circumferentially extending groove 44' is present. Various other configurations, with more or fewer slits and segments, may also be selected depending on the degree of flexibility required.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A support assembly for supporting a surface treatment pad on a backing plate mounted on the spindle of a surface treatment tool, the support assembly comprising:

a flexible front support layer having
- front and rear surfaces,
- a circumference,
- a diameter, and
- a plurality of petal-shaped segments, each petal-shaped segment separated from an adjacent petal-shaped segment by a radially extending slit;
- at least one circumferentially extending groove formed in the front surface of the flexible support layer functioning as a fold line along which each petal-shaped segment may bend in response to compressive forces;

a rigid, unslitted rear support layer having
- a front surface and a rear surface, and
- a diameter that is less than the diameter of the flexible front support layer;

a spongy, compressible center layer sandwiched between the rear surface of the flexible front support layer and the front surface of the rear support layer;

a front attachment layer adhesively secured to the front surface of the flexible front support layer, the front attachment layer comprising a first part of a two-part releasable surface treatment pad fastener that is configured to cooperate with a second part of the two-part releasable surface treatment pad fastener that is adhesively secured to a rear surface of the surface treatment pad; and a rear attachment layer adhesively secured to the rear surface of the rigid, unslitted rear layer, the rear attachment layer comprising a first part of a two-part releasable backing plate fastener that is configured to cooperate with a second part of the two-part releasable backing plate fastener that is adhesively secured to a front surface of the backing plate.

* * * * *